US005121883A

United States Patent [19]

Jouillat et al.

[11] Patent Number: 5,121,883

[45] Date of Patent: Jun. 16, 1992

[54] PUSHBUTTON HAVING A LATERALLY DIRECTED INTERNAL NOZZLE FOR A HIGH PRESSURE FAST RATE SPRAY PUMP

[75] Inventors: Claude Jouillat, Montigny-sur-Avre; Michel Brunet, Sainte-Colombe-La-Commanderie, both of France

[73] Assignee: Societe Technique de Pulverisation - Step, Verneuil-sur-Avre, France

[21] Appl. No.: 672,230

[22] Filed: Mar. 20, 1991

[30] Foreign Application Priority Data

Mar. 21, 1990 [FR] France ..... 90 03613

[51] Int. Cl.[5] ..... B05B 1/08

[52] U.S. Cl. ..... 239/490; 239/590

[58] Field of Search ..... 239/490–493, 239/337, 476, 482–485, 581.1–582.1, 331, 332, 590

[56] References Cited

U.S. PATENT DOCUMENTS

| | | | |
|---|---|---|---|
| 2,974,880 | 3/1961 | Stewart et al. | 239/590 |
| 3,648,932 | 3/1972 | Ewald et al. | 239/337 |
| 3,961,756 | 6/1976 | Martini | 239/337 |
| 4,238,055 | 12/1980 | Staar | 239/332 |
| 4,801,093 | 1/1989 | Brunet et al. | 239/490 |

FOREIGN PATENT DOCUMENTS

| | | | |
|---|---|---|---|
| 0424571 | 5/1991 | European Pat. Off. | 239/332 |
| 2502241 | 5/1976 | Fed. Rep. of Germany . | |
| 3836291 | 3/1990 | Fed. Rep. of Germany | 239/332 |
| 1576075 | 10/1980 | United Kingdom . | |

*Primary Examiner*—Andres Kashnikow
*Assistant Examiner*—Karen B. Merritt
*Attorney, Agent, or Firm*—Sughrue, Mion, Zinn, Macpeak and Seas

[57] ABSTRACT

A hollow elongate pushbutton receives a nozzle rod 2, and is mounted at a mid-portion on the valve rod of a liquid spray pump intended to operate under pressures on the order of more than 100 bars, and at a repetition rate of 50 Hz or more. The center of gravity of the pushbutton and nozzle rod assembly lies on the axis of the valve rod, to avoid vibrations during use.

4 Claims, 1 Drawing Sheet

PUSHBUTTON HAVING A LATERALLY DIRECTED INTERNAL NOZZLE FOR A HIGH PRESSURE FAST RATE SPRAY PUMP

The present invention relates to a pushbutton for a spray pump or spray head, the pump spraying laterally, and being intended more particularly to operate at high pressures (of the order of 100 bars or more) and at a high repetition rate, such as 50 operations per second (50 Hz) or more, e.g. 100 Hz or 200 Hz. The invention relates more particularly to so-called "internal" nozzles.

BACKGROUND OF THE INVENTION

One such nozzle is described, inter alia, in French patent number 2 547 737 and is constituted by associating a channel which is delimited at a spray or front end by a wall which is pierced by a central orifice, and a rod whose outside section is slightly less than the inside section of the channel, the rod being placed inside the channel, thereby leaving an empty section of small volume and thus avoiding a dead volume that would be prejudicial to good spraying. This disposition eliminates the risk of expulsion towards the front of the nozzle, which risk is not negligible when pressure is high, and it facilitates molding the pushbutton, enabling a channel of great length to be molded in a single piece.

A pushbutton is designed to be mounted on the piston rod of the pump, commonly called the "valve" rod, which is constituted by a hollow tube controlling the piston, with the substance to be sprayed being delivered via said tube. In the present invention, the spray jet is substantially perpendicular to the axis of the valve rod.

SUMMARY OF THE INVENTION

According to the present invention, the center of gravity of the pushbutton is situated on the axis of the valve rod. This disposition provides good balance and maintains position well during repetitive operation at a high rate.

The output channel of the pushbutton into which the valve rod opens out preferably has a small diameter with a maximum of about 3 mm and preferably lies in the range 2 mm to 3 mm, thereby enabling it to withstand high operating pressures while nevertheless retaining small dimensions.

BRIEF DESCRIPTION OF THE DRAWING

An embodiment of the invention is described by way of example with reference to the accompanying drawing, in which.

DETAILED DESCRIPTION

Figure 3:
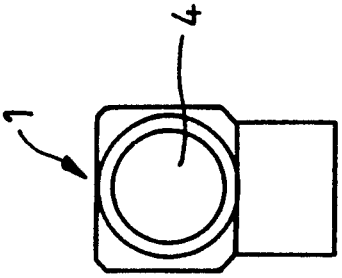
FIG. 3 is a view of the rear face of the pushbutton.
Figure 1:
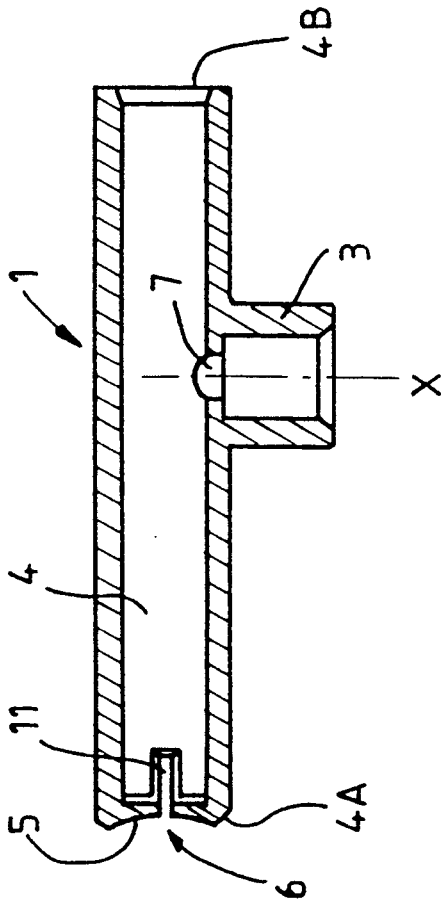
FIG. 1 is a longitudinal section view on a plane of symmetry through one example of a pushbutton of the invention without its nozzle.
Figure 2:
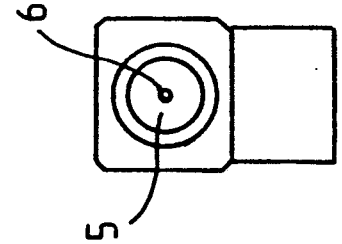
FIG. 2 is a view of the front face of the pushbutton.

The drawing shows an embodiment of a pushbutton 1 and a nozzle 2. The pushbutton has a connection endpiece 3 formed to enable the pushbutton to be fitted in conventional manner onto the end of the valve rod of a spray pulsation pump. The endpiece opens out into an outlet channel 4 which extends substantially perpendicular to the axis of the endpiece (which is the same as the axis of the valve rod). The channel 4 is delimited at its front end 4A (i.e. the outlet end for the spray jet) by a front wall 5 which is pierced in its center by a spray hole 6.

The rear end 4B is open. This disposition makes it possible to place the pushbutton on a pump mounted on a can, with a spray orifice 6 overhanging the wall of the can. The section of the channel 4 may be uniform.

However, to facilitate unmolding, the channel may be slightly conical, flaring towards its open end 4B.

In order to withstand under favorable conditions pressures that may be very high instantaneously, e.g. 100 bars or more, the diameter of the channel 4 is small in accordance with a characteristic of the present invention, and does not exceed substantially 3 millimeters. Advantageously, it lies in the range 2 millimeters to 3 millimeters. The disposition with the internal nozzle makes it possible to mold under good conditions a pushbutton having an outlet channel which is long enough to reach or project beyond the outside wall of the can, while having a diameter suitable for receiving an internal nozzle.

According to an important characteristic of the invention, the center of gravity of the pushbutton including its nozzle lies on the axis of the valve rod, i.e. on the axis X of the endpiece 3. This disposition facilitates repetitive rapid motion of the pushbutton to actuate the pump at a high rate of not less than 50 Hz, and where applicable 100 Hz or more.

Figure 4:
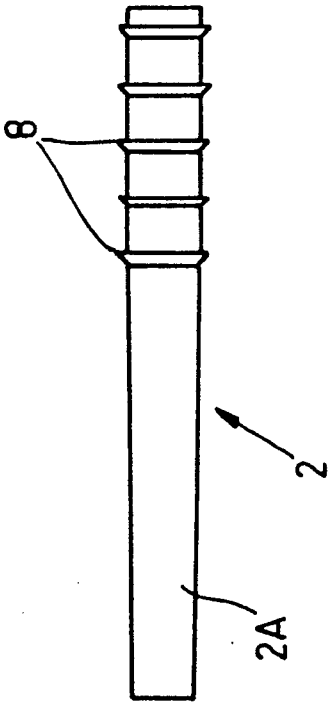
FIG. 4 is a view of the nozzle.

The nozzle 2 shown in FIG. 4 is suitable for being received in the outlet channel 4 in such a manner as to leave a small-section passage between the orifice 7 through which the endpiece 3 opens out into the channel 4 and the front end 4A of said channel, and in such a manner as to close the opening at the other end 4B.

Figure 5:
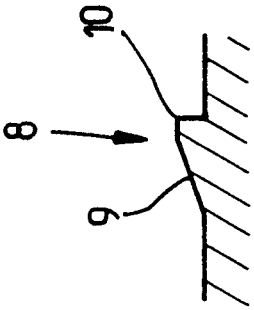
FIG. 5 is a view on a larger scale showing a detail of the nozzle.

For closure purposes, the nozzle as shown is formed with five fastening ribs 8, one of which is shown in section on a larger scale in FIG. 5. Each rib constitutes a peripheral flange going all the way round a right cross-section of the nozzle. The section of the flange constitutes a catch 9 having a latching surface 10 which is directed rearwards. These ribs thus provide both sealing inside the outlet channel and retention of the nozzle in the channel. By having a plurality of ribs, it is possible to withstand very high pressures.

It has been observed experimentally that one rib as shown is capable of withstanding a pressure of 40 bars. Thus, in theory, five ribs should withstand a pressure of 200 bars.

In order to define a passage of defined section between the orifice 7 and the spray hole 6, the front portion 2A of the nozzle is slightly smaller in diameter than the inside diameter of the channel 4, and the channel 4 is provided in the vicinity of its front end with at least three centering projections 11, thereby defining as many passages between the nozzle and the channel wall between the projections. The projections are of constant thickness apart from end chamfers for facilitating insertion of the nozzle to the end of its housing.

The front wall 5 is provided in conventional manner on its inside face with grooves running from the periphery between the centering projections 11 to the outlet orifice 6 and reaching the orifice tangentially so as to impart swirling motion on the fluid that is expelled.

In addition to being held by the ribs, the nozzle may be welded to the pushbutton once it has been installed.

A pushbutton of the invention makes it possible to operate a spray pump at a very high rate and under high pressure, thereby giving rise to a very fine spray which appears in practice to be being delivered at a constant rate, thereby giving an effect identical to that of an aerosol, or which is even better, while avoiding the drawbacks associated with using an auxiliary substance that could be considered as being harmful to the environment.

We claim:

1. A pushbutton assembly adapted to be mounted on a valve stem of a liquid spray pulsation pump and designed to operate under pressures on the order of more than 100 bars, and at a repetition rate on the order of 50 Hz or more, comprising:

a) a hollow, elongate nozzle housing open at one end (4B) and having a closure wall (5) at another, opposite end, b) an outlet orifice (6) centrally defined in the closure wall, c) a hollow connection fitting (3) extending laterally from a mid-portion of the housing and communicating with an interior thereof, the connection fitting being configured to be mounted on and over the spray pump valve stem, d) an elongate nozzle rod (2) disposed within the housing and defining an annular liquid flow passage therewith, and e) means for sealing the open end of the housing and for anchoring the nozzle rod therein, wherein the center of gravity of the pushbutton assembly lies on a central axis (X) of the valve stem.

2. A pushbutton assembly according to claim 1, wherein the hollow, elongate nozzle housing defines a channel small in diameter lying in a range of 2 mm to 3 mm.

3. A pushbutton assembly according to claim 1, wherein the sealing and anchoring means comprises at least two fastening ribs (8), each fastening rib being constituted by a peripheral flange formed around a right section of the nozzle rod, with a section of each flange constituting a latching surface directed towards a rear of the assembly and tightly engaging an interior surface of the housing.

4. A pushbutton assembly according to claim 3, wherein the interior surface of the housing is provided with centering projections (11) adjacent the closure wall for receiving a front end of the nozzle rod.

* * * * *